United States Patent [19]

Heenan

[11] 4,195,945

[45] Apr. 1, 1980

[54] SNOWPLOWABLE PAVEMENT MARKER AND BASE MEMBER THEREFOR

[75] Inventor: Sidney A. Heenan, Park Ridge, Ill.

[73] Assignee: Amerace Corporation, New York, N.Y.

[21] Appl. No.: 963,339

[22] Filed: Nov. 24, 1978

Related U.S. Application Data

[63] Continuation of Ser. No. 789,249, Apr. 20, 1977, which is a continuation-in-part of Ser. No. 681,858, Apr. 30, 1976, abandoned.

[51] Int. Cl.[2] ..... E01F 9/04

[52] U.S. Cl. ..... 404/16

[58] Field of Search ..... 404/16, 15, 14, 13, 404/12, 11; 116/DIG. 16

[56] References Cited

U.S. PATENT DOCUMENTS

| | | | |
|---|---|---|---|
| 1,910,791 | 5/1933 | Coppel | 404/16 |
| 1,927,756 | 9/1933 | Ross | 404/16 |
| 1,952,942 | 3/1934 | Ross | 404/16 |
| 1,952,943 | 3/1934 | Ross | 404/16 |
| 2,126,224 | 8/1938 | Shaffer . | |
| 2,260,498 | 10/1941 | Wise | 404/16 |
| 2,337,793 | 12/1943 | Abbott | 404/16 |
| 3,332,327 | 7/1967 | Heenan | 404/16 |
| 3,516,337 | 6/1970 | Gubela . | |
| 3,540,282 | 11/1970 | Kohler | 404/16 X |
| 3,587,416 | 6/1971 | Flanagan | 404/9 |
| 3,758,191 | 9/1973 | Hedgewick | 404/16 |
| 3,784,279 | 1/1974 | Hedgewick . | |
| 3,790,293 | 2/1974 | Heenan | 404/15 |
| 3,809,487 | 5/1974 | Flanagan | 404/15 |
| 3,975,108 | 8/1976 | Suhr | 404/16 |
| 3,980,410 | 9/1976 | Suhr | 404/16 |

*Primary Examiner*—Nile C. Byers, Jr.

*Attorney, Agent, or Firm*—Richard A. Craig; Ronald A. Sandler; S. Michael Bender

[57] ABSTRACT

A low-profile snowplowable pavement marker includes a metal base member having two arcuate-bottom keel members interconnected by an arcuate-bottom support member, the upper surfaces of the keel members respectively defining inclined ramps from a plane at one end of the base member toward the other end thereof to corresponding coplanar top surfaces, the support member having a support surface lying below the plane for supporting thereon a cube corner reflex reflector assembly partially recessed below the plane. The keel members and the support member are respectively secured in complementary arcuate recesses with the plane substantially coplanar with the roadway surface, the recesses being cut in the pavement with circular blade cutting apparatus without moving the cutting apparatus along the pavement. A bidirectional marker is shown as well as cutting apparatus for cutting the three recesses therefor simultaneously. A monodirectional pavement marker is shown, with two forms of cutting apparatus for respectively cutting the keel recesses either simultaneously or sequentially with the support member recess.

33 Claims, 19 Drawing Figures

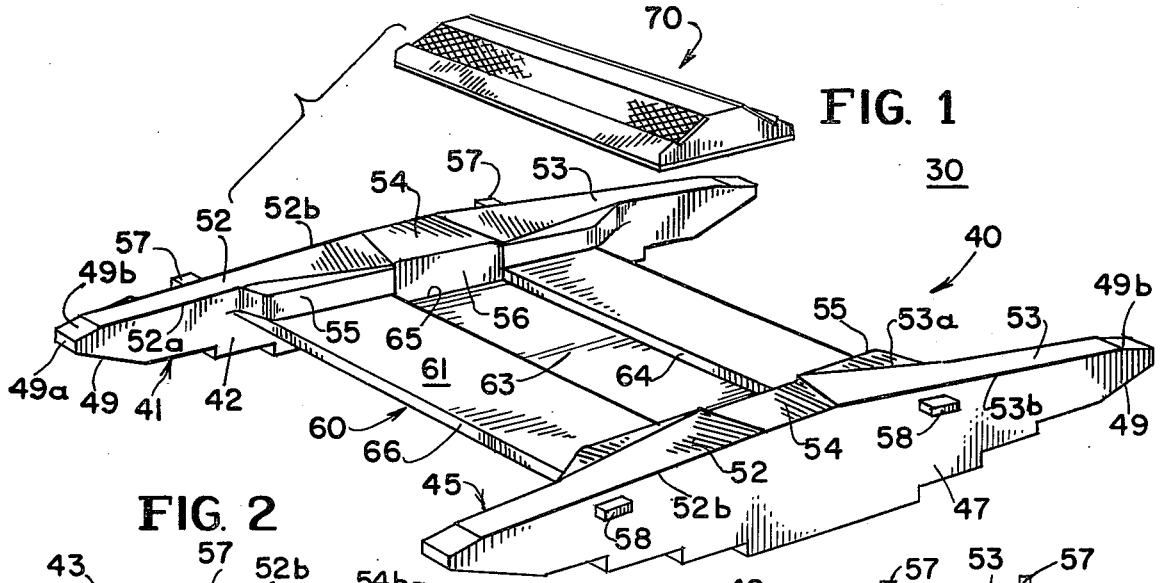
FIG. 1
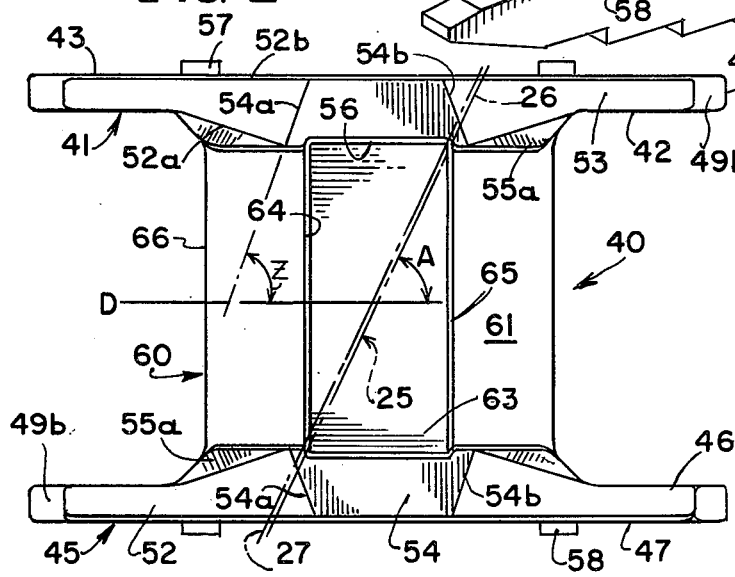
FIG. 2
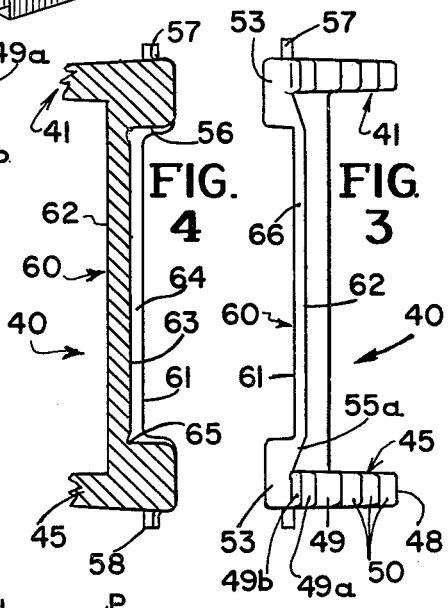
FIG. 4
FIG. 3
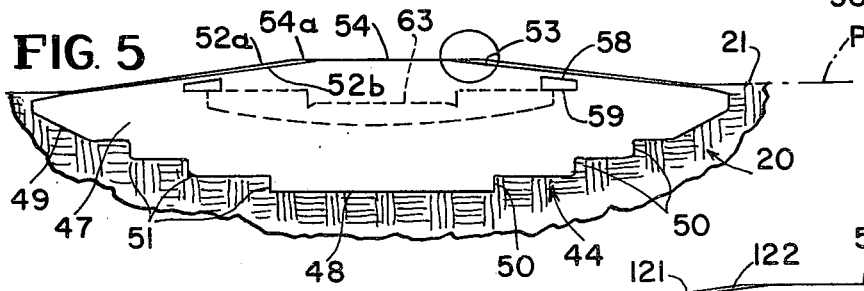
FIG. 5
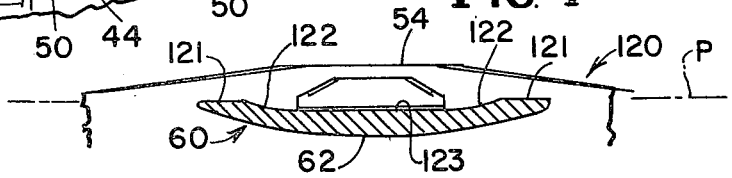
FIG. 7
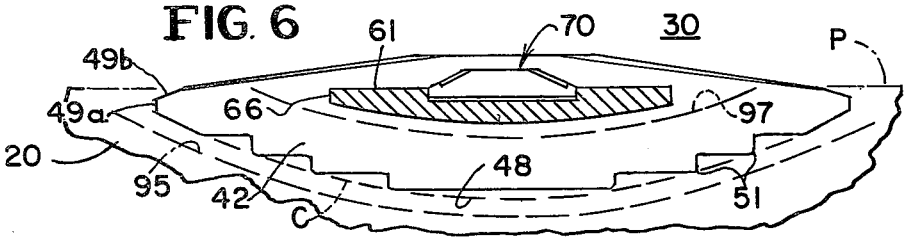
FIG. 6

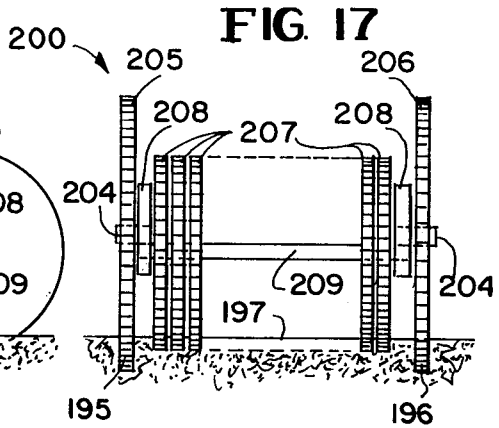
FIG. 17
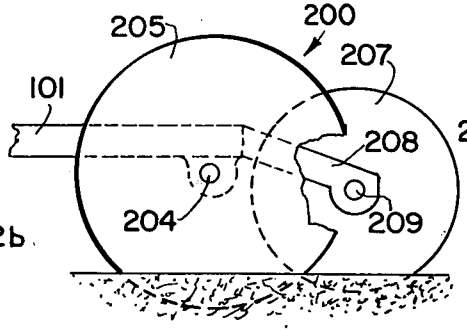
FIG. 16
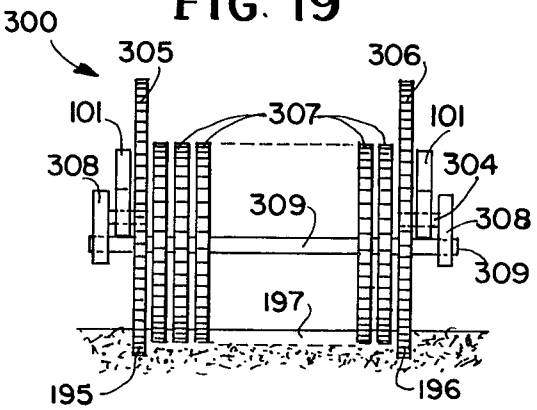
FIG. 19
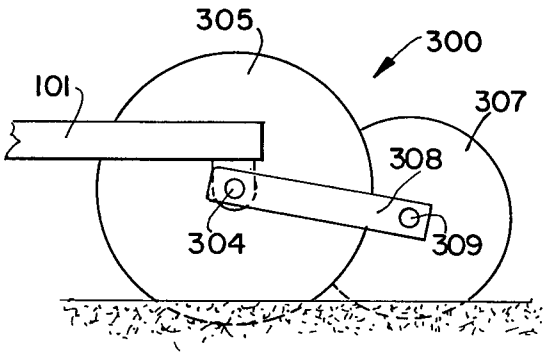
FIG. 18
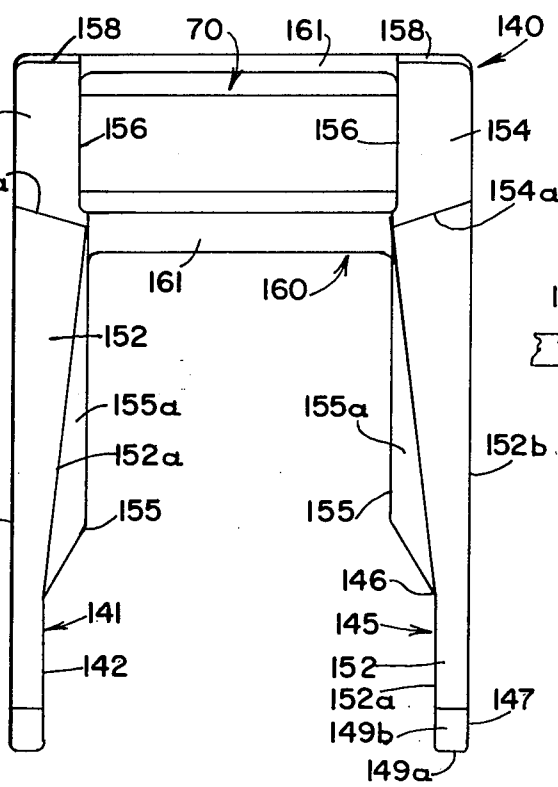
FIG. 14
FIG. 15

SNOWPLOWABLE PAVEMENT MARKER AND BASE MEMBER THEREFOR

RELATED APPLICATION

This is a continuation of application Ser. No. 789,249, filed Apr. 20, 1977, which is a continuation-in-part of application Ser. No. 681,858, filed Apr. 30, 1976 (now abandoned).

BACKGROUND OF THE INVENTION

The present invention relates to pavement markers of the cube corner reflex reflector type which are cleaned by the action of vehicular traffic on the roadway contacting the reflector, and in particular to such pavement markers which are suitable for use in snow areas and are, therefore, constructed so as to protect the reflector from contact with snowplow blades.

Pavement markers have become widely accepted as permanent installations for providing visible signals which mark traffic lanes and control the flow of traffic on roadways in connection with, or in place of, conventional painted traffic lines. While a large number of such markers employ reflectors which reflect light emanating from oncoming vehicles to provide a visible signal to the operators of such oncoming vehicles, other markers have been proposed which utilize an independent light source, such as an electric lamp located within the marker, to provide a signal visible from oncoming vehicles. The term "signal means" is employed herein to denote any such marker employing a reflector, a lamp or another light source or any arrangement which provides the desired visible signal.

A snowplowable version of such a prior art pavement marker is disclosed in U.S. Pat. No. 3,790,293, issued to S. A. Heenan et al. on Feb. 5, 1974, and U.S. Pat. No. 3,809,487, issued to R. M. Flanagan on May 7, 1974, both of which patents are commonly assigned herewith. In the arrangements used in those patents, a base member of relatively high-strength material, such as metal, includes a pair of laterally spaced apart keels which are permanently affixed to the roadway surface by insertion into grooves cut in the pavement, and a reflector body of synthetic resin material is affixed to the base member for selective removal and replacement without destruction of the base member. The base member is provided with inclined ramps for protecting the reflector body from encounters with snowplow blades.

In these prior art snowplowable pavement markers, an attempt was made to minimize the height of the pavement marker above the roadway surface by minimizing the height of the reflector body carried by the base, thereby to minimize the impact forces imparted to vehicle tires as they passed over the pavement marker. Indeed, in these prior art snowplowable pavement markers the maximum height of the marker above the roadway surface had been reduced as far as possible with existing reflex reflector bodies and installation techniques, consistent with obtaining satisfactory visibility of the pavement marker, but could not be reduced below about 0.72 inches above the pavement.

It has also been recognized in connection with these prior art pavement markers that the angle between the roadway surface and the inclined ramps of the base member should be minimized to minimize the impact forces imparted to the pavement marker and to the surrounding pavement by impact of snowplow blades with the inclined ramps of the pavement marker. While theoretically the ramp angle could be reduced as low as desired, the lower the angle the longer the ramp would have to be to maintain the same maximum height and, accordingly, the longer the keel members and the longer the grooves or recesses that would have to be cut in the pavement. The longer the grooves, the greater the weakening of the pavement and the greater the time and expense required to form the grooves. Furthermore, the longer the base member, the heavier and more expensive it is. Thus, these factors serve practically to limit the ramp angle that could be obtained with these prior art pavement markers to no lower than 6 degrees.

In addition, the prior art pavement markers were monodirectional devices. While bidirectional reflector bodies were available, in order to mount them in a metal base member for protection from impact with snowplow blades, it would be necessary to have inclined ramps extending from the reflector body in both directions. Thus, if the same ramp angle and maximum height above the roadway surface were to be maintained, it would be necessary virtually to double the length of the base member, with the attendant disadvantages discussed above.

It has been suggested in the prior art partially to recess the reflector elements below the level of the roadway surface as, for example, in U.S. Pat. No. 2,260,498, issued to L. M. Wise on Oct. 28, 1941, and U.S. Pat. No. 1,952,942, issued to D. E. Ross on Mar. 27, 1934. In Wise and Ross, because of the nature of the glass lens used, the portion of the lens disposed below the roadway would be wasted and inoperative. Further, the Wise pavement marker is a generally cylindrical body embedded in the pavement, with a part-conical inclined upper surface extending above the level of the roadway surface at an angle in excess of 25 degrees with the roadway surface, at which angle the impact forces of snowplow blades against the pavement marker are so great that they destroy the pavement marker and/or severely damage the surrounding pavement and snowplow balde. Reduction of the angle by increasing the diameter of the Wise pavement marker would require unacceptable increases in the size of the pavement recess and the weight of the pavement marker itself. Furthermore, the cross sectional outline of the Wise pavement marker body is not conducive to ready insertion into a recess which is cut or drilled in a finished pavement.

The Ross device suffers from basically the same disadvantages. Also these devices, as well as those of U.S. Pat. Nos. 3,836,275 (Finch) and 2,126,224 (Shaffer et al.), essentially try to minimize height by using small part-spherical bead-type reflectors. All have proven impractical and inefficient as a result of dirt build-up, since they are unaccessible to the wiping action of passing vehicle tires.

SUMMARY OF THE INVENTION

Therefore, there is provided in the present invention a pavement marker suitable for use in snow areas which includes a base member having inclined ramps and adapted to be embedded in the pavement, and a signal means carried by the base member in such a way that it is partially recessed in use below the level of the roadway surface thereby to minimize the total height of the pavement marker and the angle that the ramps make with the roadway surface, but without enlarging the overall length of the pavement marker.

More particularly, it is a significant feature of the present invention that the pavement marker includes a base member including two longitudinally extending and laterally spaced apart keel members interconnected by a support member having a signal means support surface thereon, the keel members and the support member being adapted to be received in complementary recesses in the pavement so that in use the support surface is disposed below the level of the roadway surface.

It is another feature of the present invention that the support member of the base member is so constructed as to facilitate the formation in the pavement of the complementary recess for receiving the support member.

It is another feature of this invention that the base member for the pavement marker comprises a separate construction on which a suitable type of signal means can be replaceably mounted.

Another feature of this invention is that the ramps terminate at coplanar top surfaces substantially parallel in use to the roadway surface and extend longitudinally a distance approximately 58% of the lateral spacing therebetween, with the inner and outer edges of each ramp being inclined at different angles to the top surface.

It is still another important feature of the present invention that a method and apparatus are provided for speedily and economically cutting in the pavement the recesses for receiving the keel members and support members of the pavement marker base member.

These advantages are obtained, and it is a general object of the present invention to obtain these advantages by providing a low-profile pavement marker for use in snow areas for establishing on a finished roadway surface a marking visible from an oncoming vehicle while protecting the marking from damage by oncoming snowplow blades during snowplowing operations, the pavement marker comprising a base member including two longitudinally extending and laterally spaced apart keel portions each extending below a plane and adapted to be respectively disposed and secured in first and second complementary recesses in the associated pavement with the associated roadway surface lying substantially in the plane, the base member having two laterally spaced apart inclined upper surfaces each forming an inclined ramp having an inner edge and an outer edge and extending longitudinally of the base member from adjacent to one end thereof upwardly toward the other end thereof and rising from the plane to an uppermost portion, the base member including a support portion interconnecting the keel portions and extending below the plane and adapted to be disposed in a third complementary recess in the associated pavement, the support portion having a support surface disposed between the inclined surfaces adjacent to the uppermost ends thereof and lying below the plane and hence in use below the level of the roadway surface and signal means carried by the support surface and disposed between and below the inclined ramps so that an oncoming snowplow blade will ride up the ramps and be deflected from contact with the signal means as the snowplow blade passes over the pavement marker, the signal means extending from below the level of the roadway surface to thereabove so as to be visible from oncoming vehicles and exposed to wiping action by the tires thereof when the base member is received and secured in the complementary recess, whereby the signal means is protected from contact with oncoming snowplow blades and is partially recessed in use below the level of the associated roadway surface so as to minimize the total height of the pavement marker above the roadway surface thereby to reduce the impact energy imparted to the pavement marker and to the pavement and to oncoming vehicles striking the marker.

In connection with the foregoing object, it is another object of the present invention to provide a pavement marker of the type set forth, wherein the keel portions and the support portion are generally arcuate in outline along the bottom thereof in order to be disposable in complementary arcuate recesses in the associated pavement.

It is another object of the present invention to provide a pavement marker of the type set forth which is bidirectional, the base member having first and second pairs of inclined upper surfaces converging upwardly from the opposite ends of the base member, the support surface being disposed between the inclined surfaces of each of said first and second pairs and supporting thereon a bidirectional signal means having two signal faces respectively facing toward the opposite ends of the base member.

Still another object of this invention is to provide a mounting base member of the type set forth for supporting thereon an associated signal means to form a pavement marker of the type set forth.

Another object of this invention is to provide a mounting base member of the type set forth wherein the inner and outer edges of each inclined surface are inclined at different angles and intersect a top surface disposed horizontally in use.

Yet another object of this invention is to provide a method of installing on a finished roadway surface a pavement marker of the type set forth by utilizing a cutting apparatus to cut the keel recesses and the support member recess in the pavement without moving the cutting apparatus from an initial operating position, the pavement marker being installed in the recesses by means of adhesive.

Still another object of this invention is to provide an apparatus for cutting the recesses in the pavement including a frame adapted to be positioned on the pavement in an operating position, and a plurality of circular cutting blades carried by the frame for rotation about a single axis, or alternatively, about multiple axes by drive means respectively to cut the keel recesses and support member recess in the pavement without moving the frame from the operating position.

In connection with the foregoing object, it is another object of this invention to provide an apparatus of the type set forth, wherein each of the first and second cutting blades for cutting the keel recesses on the one hand and the support member recess on the other are movable independently of each other between a retracted position out of contact with the pavement and a cutting position for cutting engagement with the pavement.

Further features of the invention pertain to the particular arrangement of the parts of the pavement marker and of the cutting apparatus and the steps of the installation method whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is an exploded front perspective view of a bidirectional pavement marker including a base member and a reflector assembly, constructed in accodance with an embodying the features of a first embodiment of the present invention;

FIG. 2 is a reduced top plan view of the base member of the pavement marker of FIG. 1;

FIG. 3 is an end elevational view of the base member of FIG. 2, as viewed from the right-hand end thereof;

FIG. 4 is a fragmentary view in vertical section taken along the line 4—4 in FIG. 2;

FIG. 5 is a side elevational view of the base member of FIG. 4, shown installed in place on the pavement of a roadway;

FIG. 6 is a view in vertical section taken along the line 6—6 in FIG. 2, with a reflector assembly positioned on the base member;

FIG. 7 is a fragmentary view, similar to FIG. 6, of an alternative form of base member;

FIG. 14 is a top plan view of a monodirectional pavement marker constructed in accordance with and embodying the features of a second embodiment of the present invention;

FIG. 15 is a side elevational view of the pavement marker of FIG. 14, as viewed from the left-hand side thereof;

FIG. 16 is a fragmentary side elevational view of a cutting apparatus for cutting in the pavement the recesses for mounting the pavement marker of FIG. 14;

FIG. 17 is an end elevational view of the apparatus of FIG. 16, as viewed from the right-hand end thereof;

FIG. 18 is a fragmentary side elevational view of an alternative form of cutting apparatus for cutting in the pavement the recess for mounting the pavement marker of FIG. 14; and FIG. 19 is an end elevational view of the apparatus of FIG. 18, as viewed from the right-hand end thereof.

DESCRIPTION OF THE PREFERRED EMBODIMENTS

Figure 8:
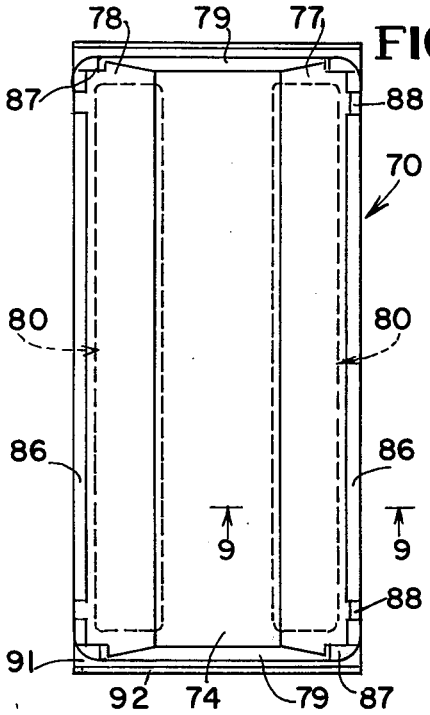
FIG. 8 is an enlarged top plan view of the reflector assembly of FIG. 1.

Referring now to FIGS. 1 through 6 and 11 of the drawings, there is illustrated a snowplowable pavement marker, generally designated by the numeral 30. In use, the pavement marker 30 is embedded in the pavement 20 of a roadway so as to project above the roadway surface 21 and be visible from oncoming vehicles traveling in either direction along the roadway surface, while being protected from snowplow blades 25 inclined at an acute angle A to the direction of travel D. The pavement marker 30 includes a base member, generally designated by the numeral 40, which is formed of a relatively high-strength material, such as metal, and supports thereon a reflector assembly, generally designated by the numeral 70. The base member 40 is preferably cast as an integral unit, and includes a pair of parallel, elongated, laterally spaced apart keel members 41 and 45, the keel member 41 having parallel substantially vertically extending inner and outer side surfaces 42 and 43, and the keel member 45 having parallel substantially vertically extending inner and outer side surfaces 46 and 47.

Each of the keel members 41 and 45 is provided with a substantially identical irregular bottom surface, generally designated by the numeral 44, which interconnects the side surfaces 42 and 43 and the side surfaces 46 and 47 along the bottoms of the keel members 41 and 45. More particularly, each of the irregular bottom surfaces 44 includes a flat horizontal bottom portion 48 disposed centrally of the keel member and a pair of downwardly sloping and slightly arcuate end portions 49 lying substantially along a common imaginary circle C and respectively extending downwardly from the opposite ends of the keel member toward the bottom portion 48, each of the end portions 49 being interconnected with the adjacent end of the flat bottom portion 48 by a plurality of substantially right-angular step portions 50. The step portions 50 define a plurality of tooth-like points 51, all of which lie along the imaginary circle C and function to retard slipping or shifting of the base member 40 with respect to the pavement.

Each of the keel members 41 and 45 is also provided with a pair of inclined upper surfaces 52 and 53 which respectively rise from adjacent to the opposite ends of the keel member to uppermost portions which join a flat top surface 54 and interconnect the side surfaces 42, 43 and 46, 47 at radiused corners to prevent stress concentrations when the base member 40 is struck by a plow blade. The lower ends of the inclined surfaces 52 and 53 respectively join short inclined surfaces 49*b* which slope downwardly from the inclined surfaces 52 and 53 toward the adjacent ends of the base member 40 and are respectively connected to the end portions 49 by short vertical end surfaces 49*a*. The base member 40 has a plane P which is substantially parallel to the top surfaces 54 and intersects the short inclined surfaces 49*b* slightly above their lines of intersection with the inclined upper surfaces 52 and 53.

Each of the inclined upper surfaces 52 has an inner edge 52*a* which is inclined with respect to the plane P at a first acute angle X (see FIG. 11), and an outer edge 52*b* which is inclined with respect to the plane P at a second acute angle Y. In like manner, each of the inclined upper surfaces 53 has an inner edge 53*a* which is inclined with respect to the plane P at the angle X, and an outer edge 53*b* which is inclined with respect to the plane P at the angle Y. Thus, each of the inclined upper surfaces 52 and 53 is slightly sloped downwardly and laterally outwardly of the base member 40.

More particularly, the inner edges 52*a* of the inclined upper surfaces 52 intersect the top surfaces 54 a slight distance forwardly of the points where the outer edges 52*b* intersect the top surfaces 54, the base member 40 being oriented with the longitudinal axis thereof extending parallel to the direction of travel D, so that the lines of intersection 54*a* between the inclined upper surfaces 52 and the top surfaces 54 are each disposed at an acute angle with respect to the direction of travel D. In like manner, the inner edges 53*a* of the inclined upper surfaces 53 intersect the top surfaces 54 a slight distance forwardly of the points where the outer edges 53*b* intersect the top surfaces 54, so that the lines of intersection 54*b* between the inclined upper surfaces 53 and the top surfaces 54 are each disposed at the angle Z with respect to the direction of travel D. The angle Z is preferably greater than or equal to the plow blade angle A, being generally in the range of between 60 degrees and 75 degrees, although it could be slightly less than the angle A. The short inclined surfaces 49*b* of the keel member 41 are respectively coplanar with the short inclined surfaces 49*b* of the keel member 45 and are preferably inclined at an angle of approximately 15 degrees with respect to the plane P.

The portions of the inner side surfaces 42 and 46 of the keel members 41 and 45 above the plane P extend inwardly to form thickened portions 55 extending from approximately midway between the ends of the inclined surfaces 52 to approximately midway between the ends of the inclined surface 53, each of the thickened portions 55 having sloping shoulder portions 55*a* and a recessed inner side wall portion 56 centrally thereof. Extending laterally outwardly from the keel members 41 and 45 are longitudinally spaced apart support tabs 57 and 58, the tabs 57 and 58 all having bottom surfaces 59 which are coplanar and lie substantially in the plane P.

Interconnecting the thickened portions 55 of the keel members 41 and 45 is a web-like support member, generally designated by the numeral 60, which is substantially rectangular in plan outline. The support member 60 has a flat planar top surface 61 which lies substantially in the plane P and an arcuate part-cylindrical convex bottom surface 62 which is connected at the opposite ends thereof to the top surface 61 by short end surfaces 66. Recessed in the top surface 61 centrally thereof and parallel thereto is a support surface 63 which lies below the plane P and extends transversely substantially all the way across the support member 60, and which is longitudinally substantially coextensive with the recessed side portions 56 of the keel members 41 and 45. Substantially vertically extending end walls 64 extend downwardly from the top surface 61 at the opposite ends of the support surface 63, the end walls 64 and the recessed inner side wall portions 56 of the keel members 41 and 45 all being connected to the support surface 63 by a peripheral channel or groove 65 which extends all the way around the support surface 63 and is generally arcuate in transverse cross section (see FIG. 4).

Figure 9:
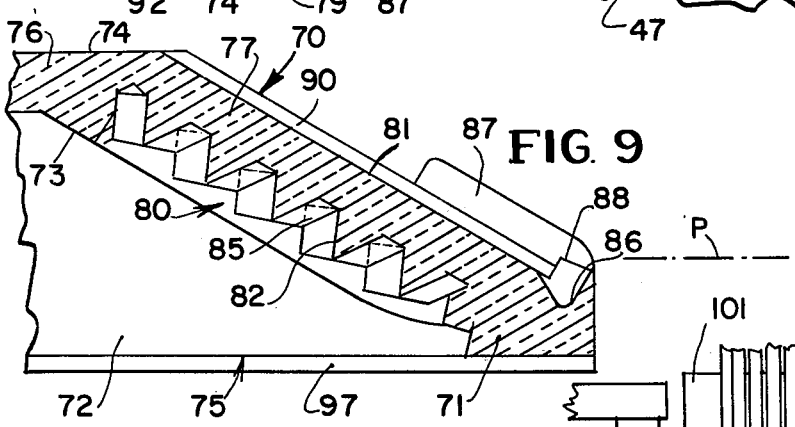
FIG. 9 is an enlarged fragmentary view in vertical section taken along the line 9—9 in FIG. 8.
Figure 10:
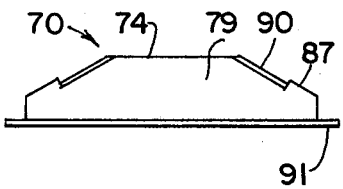
FIG. 10 is an end elevational view of the reflector assembly of FIG. 1.

Referring now also to FIGS. 8–10 of the drawings, the reflector assembly 70 is dimensioned to fit between the end walls 64 and the recessed inner side wall portions 56 to be supported upon the support surface 63. The reflector assembly 70 preferably may be generally of the type disclosed in U.S. Pat. No. 3,332,327, issued to S. A. Heenan on July 25, 1967 and commonly assigned herewith. In a preferred form, the reflector assembly 70 will be provided with a glass overlay to render it highly abrasion resistant, as disclosed in abandoned in copending application Ser. No. 681,860, filed Apr. 30, 1976 in the names of G. W. Johnson, Jr. and S. A. Heenan, and a continuation-in-part thereof filed Apr. 20, 1977 under Ser. No. 789,266, both commonly assigned herewith. Alternatively, the reflector assembly 70 may be of the type disclosed in abandoned copending application Ser. No. 681,859, filed Apr. 30, 1976 in the name of S. A. Heenan, and a continuation-in-part thereof filed Apr. 20, 1977 under Ser. No. 789,265, both commonly assigned herewith. The disclosures of the applications identified in this paragraph are incorporated herein by reference.

The reflector assembly 70 includes a body or shell 71 of light-transmitting synthetic resin which, in use, is filled or "potted" with a relatively rigid filler material to form a solid core 72 which is contiguous with the inner surface 73 of the shell 71 and serves to reinforce the shell 71 and provide a solid, rugged structure capable of withstanding forces applied to the reflector assembly 70 when the outer surface 74 of the shell 71 is struck by vehicular traffic during service. The reflector assembly 70 is provided with a generally horizontal base 75 for cooperatively engaging the surface on which the reflector assembly 70 is to be installed. The shell 71 includes a generally horizontal top wall 76 which is raised vertically above the base 75 and is interconnected therewith by opposed inclined front and rear walls 77 and 78 and opposed substantially vertically extending side walls 79.

Each of the inclined walls 77 and 78 is provided with a reflector system, generally designated by the numeral 80, and including a generally planar obverse light-receiving face 81 on the outer surface of the shell 71 and a reverse light-receiving face 82 on the inner surface of the shell 71. The reverse face 82 preferably being coated with a reflecting system 80 employed is a triple mirror reflex reflector system in principle, the reverse face 82 conimpinging on the reverse face 82. Each reflector element 85 having three substantially square planar surfaces arranged mutually at right angles and meeting at a common point remote from the obverse face 81, thus forming a cube corner, the axis of which is arranged to be generally in alignment with light rays refracted from the obverse face 81. The reverse face 82, including at least the light reflecting elements 85, is preferably coated with a light-reflecting material, such as by metallizing. Extending between the end walls 79 along the bottom edges of the obverse faces 81 are two parallel gutters 86. Integral with each of the front walls 77 adjacent to the opposite ends thereof and extending upwardly therefrom substantially normal thereto from the gutters 86 partway to the upper ends of the obverse faces 81 are parallel pairs of shoulder flanges 87. Extending upwardly from the gutters 86 at points spaced a predetermined slight distance inwardly from the opposite ends thereof are two lugs 88. Overlying each of the obverse faces 81 is a flat glass layer 90 which extends substantially the entire length of the obverse face 81 between the inner surfaces of the shoulder flanges 87, and upwardly from the lugs 88 to the top surface 74 of the shell 71, each of the glass layers 90 preferably being secured to its associated obverse face 81 by a suitable adhesive. The glass layers 90 serve to provide additional protection against abrasion of the obverse faces 81 of the reflecting systems 80.

Fixedly secured to and completely covering the base 75 is a pad 91 of an adhesive, impact-absorbing material, the bottom surface of which may be covered with a suitable release liner 92. In assembly of the reflector assembly 70 with the base member 40 of the pavement marker 30, the release liner 92 is removed and the pad 91 is placed upon the support surface 63 of the base member 40 with the obverse faces 81 of the reflector systems 80 respectively facing toward the opposite ends of the pavement marker 30, i.e., facing the opposed directions of oncoming vehicles. It will be understood that the reflector assembly 70 may be assembled with the base member 40 either before or after the base member 40 is installed on the pavement. Significantly, the adhesive attachment of the reflector assembly 70 to the base member 40 permits later removal and replacement of the relfector assembly 70 in the event it becomes damaged, worn or the like, without removing the base member 40 from the pavement.

It is a significant feature in reducing the overall height of the marker of the present invention that when the reflector assembly 70 is mounted in place upon the support surface 63, substantially the entire obverse face 81 of the reflecting system 80 lies above the plane P, but the lowermost ones of the reflector elements 85 lie below the plane P, but even so are operative to reflect incident light even adjacent to the lower edge of the obverse face 81, by reason of downward refraction of the incident light by the front face. If the reflective area were projected parallel to the nominal refracted ray, the lower edge of such projection would intersect the front face substantially at the plane P.

Furthermore, the vertical distance between the top surface 74 of the shell 71 and the bottom surface of the pad 91 is such that when the reflector assembly 70 is mounted in place upon the support surface 63 of the base member 40, the reflector assembly 70 is at all points thereof below the inclined upper surfaces 52 and 53 and the top surfaces 54 of the base member 40 a predetermined distance sufficient to prevent contact of the reflector assembly 70 by the corners of angled plow blades. In other words, when the reflector assembly 70 is mounted in place and the plane P is disposed horizontally, a vertical line extending upwardly from any point on the reflector assembly 70 will intersect a plane parallel to the inclined surfaces 52 or 53 or the top surface 54 a finite vertical distance above that point on the reflector assembly 70 (see FIG. 6).

Referring to FIG. 7 of the drawings, there is illustrated an alternative form of base member, generally designated by the numeral 120, which is substantially identical to the base member 40 except for the arrangement of the top surface of the support member 60. More particularly, in the base member 120, the support member 60 is provided at the opposite ends thereof with two short coplanar flat top surfaces 121 respectively connecting concave cylindrical surfaces 122 which are substantially concentric with the bottom cylindrical surface 62, and are interconnected at the bottom edges thereof by a planar support surface 123 parallel to the top surfaces 121. The support surface 123 is sufficiently recessed below the top surfaces 121 so as to be able to accommodate the reflector assembly 70 therein in essentially the same manner as was described above with respect to the base member 40. This alternative arrangement, while still precluding entry of the plow blade, facilitates the entry of vehicle tires onto the arcuate surfaces 122 so that the wiping action of the tires will be effected further down on the glass layers 90 than is possible with the base member 40, thereby achieving a more complete wiping of the glass layers 90.

In installation of the pavement marker 30 on the pavement 20, the base member 40 must be embedded in the pavement so that the roadway surface 21 will lie substantially in the basal plane P of the base member 40. This necessitates that the bottom portions of the keel members 41 and 45 and the support member 60 respectively be recessed below the roadway surface 21 in corresponding grooves or recesses in the pavement 20. It is a significant feature of the present invention that the pavement marker 30, and particularly the base member 40 thereof, has been constructed greatly to facilitate the installation of the pavement marker 30 on the pavement 20 so that the support surface 63 lies below the roadway surface 21, all without enlarging the overall length of the pavement marker 30, thereby to minimize the maximum height of the pavement marker 30 above the roadway surface 21 while maintaining an adequately low angle between the inclined upper surfaces 52 and 53 and the roadway surface 21.

More particularly, as was described above, the bottom surfaces 44 of the keel members 41 and 45 are generally arcuate in overall outline, and the bottom surface 62 of the support member 60 is arcuate in outline, thereby permitting the keel members 41 and 45 and the support member 60 to be respectively received in complementary arcuate grooves or recesses 95, 96 and 97 in the pavement 20. Such arcuate grooves can be conveniently cut with circular cutting blades suitable for cutting concrete or the like. Circular blade concrete cutting machines are known in the prior art and, indeed, are routinely used to form the arcuate keel recesses for installing the snowplowable pavement markers disclosed in the aforementioned U.S. Pat. Nos. 3,790,293 and 3,809,487.

However, such prior art cutting machines have been provided with only two laterally spaced apart coaxial circular saw blades of equal diameter for forming the keel recesses, which recesses are relatively narrow, typically no wider than the groove cut by a single saw blade. Such prior art machines are not capable of cutting a wide arcuate groove in the pavement, nor are they capable of cutting different size grooves without changing blades. Thus, were such prior art machines utilized to install the pavement marker of the present invention, it would be necessary either to use separate machines, or to perform several cutting or machining operations, one utilizing the prior art machine to cut the keel grooves or recesses, and a separate machining operation or perhaps a series of such operations to form the wide shallow groove necessary to accommodate the support member 60 of the pavement marker 30. Such a multi-step procedure would be unacceptably time-consuming and expensive, as well as hazardous.

Figure 12:
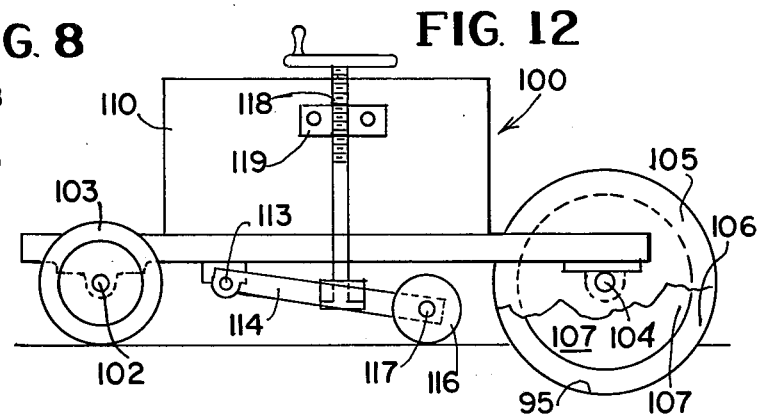
FIG. 12 is a side elevational view of a cutting apparatus for cutting in the pavement the recesses for receiving the pavement marker of FIG. 1, with a portion of the blade assembly broken away.
Figure 11:
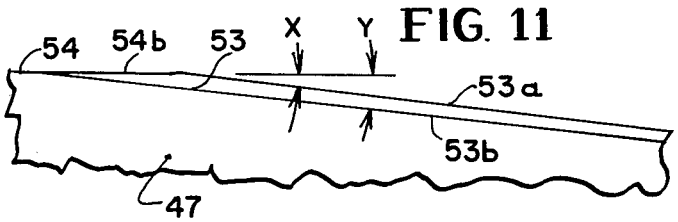
FIG. 11 is an enlarged fragmentary side elevational view of a portion of the base member shown in FIG. 5.
Figure 13:
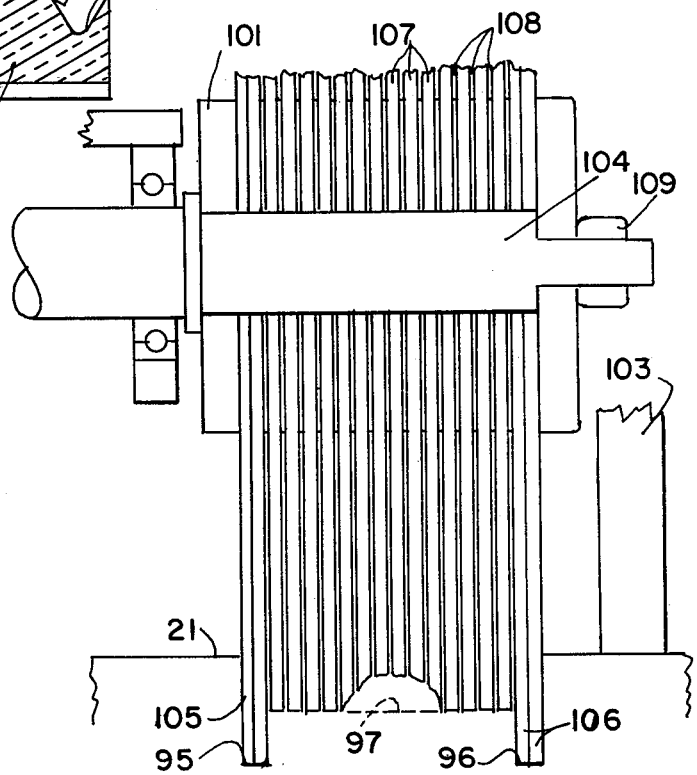
FIG. 13 is an enlarged, fragmentary end elevational view in partial vertical section of the apparatus of FIG. 12, as viewed from the right-hand end thereof.

Accordingly, referring now to FIGS. 12 and 13 of the drawings, there is provided in the present invention a novel cutting apparatus permitting easy installation of the marker 30. The cutting apparatus is generally designated by the numeral 100, and is capable of simultaneously cutting the recesses 95, 96 and 97 in a single operation. The cutting apparatus 100 includes a generally rectangular frame 101, having rotatably secured thereto adjacent to a rear end thereof a transversely extending axle 102 coupled at the opposite ends thereof to a pair of support wheels 103 for rolling the cutting apparatus 100 along the roadway surface 21. It will be understood that additional pairs of support wheels could be mounted on the frame 100, as needed or desired. Carried by the frame 101 adjacent to the front end thereof is a transversely extending rotatably mounted horizontal axle or shaft 104 having fixedly secured thereto at laterally spaced apart points thereon two pairs of relatively large side-by-side circular cutting blades 105 and 106, dimensioned and positioned for respectively cutting the keel recesses 95 and 96 in the pavement 20. Fixedly secured to the shaft 104 between the cutting blades 105 and 106 are a plurality of smaller diameter coaxial circular cutting blades 107 arranged closely together and equidistantly spaced apart by spacers 108 so as to cut a substantially continuous arcuate recess 97 in the pavement 20 between the recesses 95 and 96 for accommodating the support member 60 of the pavement marker 30. The cutting blades 105–107, the spacers 108 and the washers 109 are all securely held in place on the shaft 104 for rotation therewith by nuts 109A. If desired, the shaft 104 could be mounted for movement away from the pavement 20 when not cutting, to facilitate movement of the apparatus 100 along the pavement 20 between cutting operations. The basic cutting machine may be of the type manufactured by Clipper Manufacturing Company, Model C-600-K.

Also mounted on the frame 101 is a suitable drive mechanism, generally diagrammatically represented by the numeral 110, which may be any suitable type of electric or gasoline-powered motor or the like, coupled by suitable means such as a belt or chain to the shaft 104 for rotatably driving same and thus rotatably driving the cutting blades 105–107.

The cutting apparatus 100 also includes a limit assembly, generally designated by the numeral 115, which comprises a pivot arm 114 pivotally mounted at one end thereof on a shaft 113 carried by the frame 101, the distal end of the pivot arm 114 carrying a shaft 117 on which is pivotally mounted a guide wheel 116 adapted for engagement with the roadway surface 21. Secured to the frame 101 is an internally threaded nut member 119 with which is threadedly engaged a handled setscrew 118, the end of which bears against the pivot arm 114.

In operation, the cutting apparatus 100 is disposed upon the roadway surface 21 and locked in an operating position, with the cutting blades 105–107 positioned for cutting the recesses 95–97 in the desired location on the pavement 20. It will be understood that, initially, the cutting blades 105–106 are substantially tangent to the roadway surface 21, whereby the frame 101 is inclined upwardly and the setscrew 118 is out of engagement with the pivot arm 114. When the cutting blades 105–107 are driven, they serve to cut the arcuate recesses 105–107 in the pavement 20 in a well-known manner, the recesses 95 and 96 being deeper than the recess 97 because of the different diameters of the cutting blades. The setscrew 118 is set so that it will engage the pivot arm 114 and thereby stop the downward movement of the frame 101 and the cutting blades 105–107 when the recesses 95–97 have reached their predetermined desired depths. Thus, the cutting apparatus 100 permits accurate simultaneous cutting of the recesses 95–97 without movement of the apparatus 100 from its operating position.

The recesses 95–97 are then cleaned and a suitable epoxy adhesive material is deposited therein, the adhesive material being such that it adheres to both the material of the pavement 20 as well as the material of the keel members 41 and 45 and support member 60. The keel members 41 and 45 and the support member 60 are then respectively inserted into the recesses 95–97 and adhesively secured therein at a depth such that the roadway surface 21 lies substantially in the plane P, insertion of the base member 40 to a greater depth being prevented by engagement of the support flanges 57 and 58 with the roadway surface 21.

It will be appreciated that when thus secured in place, the pavement marker 30 is disposed so that the top surface 61 of the support member 60 is substantially coplanar with the roadway surface 21, whereby the obverse faces 81 of the reflector system 80 extend above the roadway surface 21 so as to be clearly visible between the keels 41 and 45 from oncoming vehicles approaching in either direction along the roadway. However, the lower portion of the reflector assembly 70 is recessed below the roadway surface 21 so as to minimize the overall height of the pavement marker 30, thereby minimizing the impact force imparted to vehicle tires and snowplow blades which contact the pavement marker 30.

The angle X at which the inner edges **52*a* and 53*a* of the inclined upper surfaces 52 and 53 are inclined to the roadway surface is preferably approximately 6.5 degrees, while the angle Y at which the outer edges 52*b* and 53*b* are inclined is approximately 6 degrees, the inclined upper surfaces 52 and 53 forming inclined ramps which serve to deflect oncoming snowplow blades upwardly out of contact with the reflector assembly 70, which is at all points disposed below the inclined upper surfaces 52 and 53 and the top surfaces 54. Thus, the inclined upper surfaces 52 and 53 slope slightly downwardly toward the outer sides of the base member 40 and respectively intersect the top surfaces 54 at oblique horizontal intersection lines 54*a* and 54*b*. Therefore, it can be seen that the lengths of the top surfaces 54, measured longitudinally of the base member 40, are greater along the inner edges thereof than along the outer edges thereof. More particularly, in the preferred embodiment of the invention the length of the top surfaces 54** along the inner edges thereof is substantially equal to 0.58 times the lateral distance therebetween.

This lengthening of the inner edges of the top surfaces 54 is a significant feature of the present invention, and it can be seen that the inclination of the inner edges **52*a* and 53*a* of the inclined upper surfaces 52 and 53 at a slightly greater angle than the outer edges 52*b* and 53*b* thereof, permits this lengthening of the inner edges of the top surfaces 54 without any increase in the overall length of the base member 40, and without any increase in the inclination of the outer edges 52*b* and 53*b*. The purpose of this configuration is to prevent angled plow blades from dropping between the top surfaces 54 and damaging the reflector assembly 70. It has been found that for the vast majority of snowplow blades the angle A that the blade makes with the direction of travel is approximately 60 degrees. Referring to FIG. 2 of the drawings, the trailing end 26 of the plow blade 25 must arrive at the top surface 54 of the keel member 41 before the leading end 27 of the blade 25 leaves the top surface 54 of the keel member 45, otherwise the blade 25 could move below the top surfaces 54 of the base member 40 and may contact the reflector assembly 70. Thus, the inside edges of the top surfaces 54 must have a length substantially equal to the lateral distance therebetween times the cotangent of the blade angle A. Therefore, for a 60 degree blade angle A, the length of the inside edges of the top surface 54** must be substantially equal to at least about 0.58 times the lateral distance therebetween.

It can be seen that as the plow blade 25 approaches the pavement marker 30 in the direction D in FIG. 2, it will first contact the outer edge **53*b* of the inclined upper surface 53 of the keel member 45. It has been recognized that an angled plow blade will ride along that outer edge 53*b* and will not contact the inner edge 53*a*, even when the angle of inclination of the inner edge 53*a* is as much as ½ degree higher than that of the outer edge 53*b*. Thus, by increasing the angle of inclination X of the inner edges 53***a* to approximately 6.5 degrees, it has been possible to lengthen the inner edges of the top surfaces 54 by approximately ½ inch, without increasing the rate at which the plow blade is displaced upward by the inclined upper surfaces 52 or 53. To be more specific, the vertical angle of inclination X of the inner edges 52*a* and 53*a* can be increased until the horizontal lines of intersection 54*a* and 54*b* thereof with the top surfaces 54 form an angle Z with the longitudinal axis of the pavement marker 30 which is equal to the angle A that the plow blade makes with that longitudinal axis. Accordingly, it can be seen that this construction permits an effective lengthening of the top surfaces 54 without either increasing the angle of inclination of the parts of the inclined upper surfaces 52 and 53 which contact the plow blade, or increasing the overall length of the base member 40. The total savings in length is the lateral width of the top surface 54 at the point of intersection with the outer edge 52*b* or 53*b* multiplied by 2 cot Z.

In addition to effectively protecting the reflector assembly 70 from contact with snowplow blades, the shallowness of the pavement marker 30 and the distance between the keel members 41 and 45 is such as to permit the relatively flexible tires of oncoming vehicles to contact the glass layers 90 on the reflector assembly 70 thereby to provide a wiping action for cleaning the front faces of the glass layers 90, while the glass layers 90 protect the obverse faces 81 from abrasion. These advantages are accomplished, and a bidirectional pavement marker is provided, all with a total pavement marker length which is substantially the same as that of the monodirectional pavement markers disclosed in the aforementioned prior art U.S. Pat. Nos. 3,790,293 and 3,809,487, and with an overall height above the roadway surface 21 about 40–45% less than that of the pavement markers of those patents.

In a constructional model of the pavement marker 30, the base member 40 is preferably an integral metal casting, the dimensions of which are such that when installed in place on the pavement in the position illustrated in FIG. 6, the maximum height of the pavement marker 30 above the roadway surface 21 is approximately 0.41 inches and the overall length of the base member 40 is approximately 9.25 inches. The low angle of 6 degrees of the outer edges of the ramps to the plane P, together with the lower height, materially reduces impact of snowplow blades against the base member 40, thus relieving the "jolt" felt by the driver of a plow, and minimizing the impact forces on the underlying roadway surface, and reducing the area of unplowed road surface caused by the raising of the plow blade. It also serves to reduce the impact forces transmitted to the tires of vehicles which pass over the marker. The inner edges 52*a* and 53*a* of the inclined upper surfaces 52 and 53 are inclined at an angle of approximately 6.5 degrees with respect to the plane P, and the inclined surfaces 49*b* are inclined at an angle of approximately 15 degrees with respect to the plane P and extend therebelow so that oncoming snowplow blades will not strike the leading edges of the keel members 41 and 45. The vertical distance between the plane P and the support surface 63 is approximately 0.16 inches, so that the total vertical distance between the support surface 63 and the top surfaces 54 is approximately 0.57 inches. The total height of the reflector assembly 70 is approximately 0.44 inches.

Referring now also to FIGS. 14 and 15 of the drawings, there is illustrated a monodirectional snowplowable pavement marker, generally designated by the numeral 130, which is suitable for use in snow areas and includes a base member 140 having supported thereon the reflector assembly 70. By "monodirectional", it is meant that the marker will be plowed in one direction only, and not necessarily that the reflector assembly is capable of reflecting light in only one direction. The base member 140 is similar in shape to the base members of the monodirectional pavement markers disclosed in the aforementioned U.S. Pat. Nos. 3,790,293 and 3,809,487. However, the base member 140 of the present invention has been significantly improved so that the overall height of the pavement marker 130 above the roadway surface 21 when the pavement marker is installed is substantially less than the overall height of the prior art pavement markers, and the angles of the inclined ramps which protect the reflector assembly 70 are substantially less than the angles of the ramps in the prior art pavement markers, and yet the overall length of the base member 140 is less than that of the prior base members.

The base member 140 is preferably cast as an integral unit of a relatively high-strength material, such as metal, and includes a pair of parallel, elongated, laterally spaced apart keel members 141 and 145, the keel member 141 having parallel substantially vertically extending inner and outer side surfaces 142 and 143, and the keel member 145 having parallel substantially vertically extending inner and outer side surfaces 146 and 147.

Each of the keel members 141 and 145 is provided with a substantially identical irregular bottom surface, generally designated by the numeral 144, which interconnects the side surfaces 142 and 143 and the side surfaces 146 and 147 along the bottoms of the keel members 141 and 145. More particularly, each of the irregular bottom surfaces 144 includes a flat horizontal bottom portion 148 disposed centrally of the keel member and a pair of downwardly sloping and slightly arcuate end portions 149 lying substantially along a common imaginary circle $C_1$ and respectively extending downwardly from the opposite ends of the keel member toward the bottom portion 148, each of the end portions 149 being interconnected with the adjacent end of the flat bottom portion 148 by a plurality of substantially right-angular step portions 150. The step portions 150 define a plurality of tooth-like points 151, all of which lie along the circle $C_1$ and serve the same function as the points 51 described above in connection with FIGS. 1–6.

Intersecting the inclined portions 149 at the front ends of the keel members 141 and 145 are vertical front end surfaces 149*a* the upper ends of which intersect short inclined upper surfaces 149*b* which rise rearwardly to a plane $P_1$ at an angle of about 15 degrees thereto, at which point they respectively intersect inclined upper surfaces 152 which rise rearwardly above the tops of the keel members 141 and 145 to uppermost portions where they intersect top surfaces 154 which are parallel to the plane $P_1$ and spaced approximately 0.40 inches thereabove, the top surfaces 154 terminating in inclined rear surfaces 158.

Each of the inclined upper surfaces 152 has an inner edge 152*a* which is inclined with respect to the plane $P_1$ at a first acute angle of approximately 4.5 degrees, and an outer edge 152*b* which is inclined with respect to the plane $P_1$ at a second acute angle of approximately 4 degrees. Thus, each of the inclined upper surfaces 152 is slightly sloped downwardly and laterally outwardly of the base member 140.

More particularly, the inner edges 152*a* of the inclined upper surfaces 152 respectively intersect the top surfaces 154 a slight distance forwardly of the points where the outer edges 152*b* intersect the top surfaces 154, the base member 140 being oriented in use with the longitudinal axis thereof extending parallel to the direction of vehicle travel, so that the lines of intersection 154*a* between the inclined upper surfaces 152 and the top surfaces 154 are each disposed at an acute angle with respect to the direction of travel. This angle is preferably greater than or equal to the plow blade angle A, for the same reasons as were set forth above with respect to FIGS. 1–6.

The inner surfaces 142 and 146 of the keel members 141 and 145 above the plane $P_1$ respectively extend inwardly to form thickened portions 155 from approximately midway between the ends of the inclined upper surfaces 152 to the rear ends of the keel members 141 and 145, each of the thickened portions 155 having sloping shoulder portions 155*a* and a recessed inner side wall portion 156 adjacent to the rear end thereof.

Interconnecting the thickened portions 155 of the keel members 141 and 145 adjacent to the rear ends thereof is a support member, generally designated by the numeral 160, which is substantially rectangular in plan outline. The support member 160 has a flat planar upper surface 161 which lies substantially in the plane $P_1$ and an arcuate part-cylindrical convex bottom surface 162 which is connected at the front ends thereof to the upper surface 161 by a rounded end surface 166. Recessed in the upper surface 161 centrally thereof and parallel thereto is a support surface 163 which lies below the basal plane $P_1$ and extends transversely all the way across the support member 160 and is longitudinally substantially coextensive with the recessed inner side wall portions 156 of the keel members 141 and 145. Substantially vertically extending end walls 164 extend downwardly from the upper surface 161 at the opposite ends of the support surface 163, the end walls 164 and the recessed inner side wall portions 156 of the keel members 141 and 145 all being connected to the support surface 163 by a peripheral channel or groove (not shown) like the channel 65 in the base member 40, which extends all the way around the support surface 163 and is arcuate in transverse cross section.

The rear end of the upper surface 161 and the lower ends of the rear surfaces 158 of the keels are joined to the rear end of the arcuate bottom surface 162 of the support member 160 by a rounded surface 167.

The reflector assembly 70 is mounted on the support surface 163 in exactly the same manner as was described above with respect to the support surface 63 of the pavement marker 30, with substantially all portions of the reflector assembly 70 below the upper edges of the lugs 88 being disposed below the plane $P_1$ and all portions of the reflector assembly 70 above the upper edges of the lugs 88, including substantially the entire obverse faces 81, being disposed above the plane $P_1$. Again, the lowermost ones of the reflex light reflecting elements 85 lie below the plane $P_1$. Furthermore, the vertical distance between the top surface of the reflector assembly 70 and the bottom surface of the pad 91 is such that when the reflector assembly 70 is mounted in plane upon the support surface 163 of the base member 140, the reflector assembly 70 at all points thereof is spaced a predetermined distance vertically below a plane parallel to the top surfaces 154 and the inclined upper surfaces 152 of the base member 140 to prevent plow blade corners from contacting the reflector assembly 70.

As was explained above with respect to the bidirectional pavement marker 30, the fact that the inner edges 152*a* of the inclined upper surfaces 152 are inclined to the plane $P_1$ at a greater angle than are the outer edges 152*b*, means that the top surfaces 154 can effectively be lengthened without increasing the overall length of the base member 140 and without changing the angle of the outside edges 152*b* which contact the oncoming plow blade. As was also explained above, the angles between the longitudinal axis of the base member 140 and the lines of intersection 154*a* can be as little as the angle A of the plow blade with the direction of travel.

It will be noted that the pavement marker 130 has all the advantages of the pavement marker 30 in terms of ease of installation, by reason of the arcuate outlines of the bottom surfaces of the keel members 141 and 145 and the support member 160. Thus, in installation of the pavement marker 130, the keel members 141 and 145 and the support member 160 are respectively received and adhesively secured in complementary arcuate recesses 195, 196 and 197 which are cut in the pavement 20 with circular cutting members, the pavement marker 130 being inserted in the recesses 195–197 to a depth such that the roadway surface 21 lies substantially in the plane $P_1$. It will be appreciated that one of the two obverse faces 81 of the reflector assembly 70 will extend above the roadway surface 21 and will be visible between the keel members 141 and 145 to oncoming vehicles approaching from the forward end of the pavement marker 130.

Indeed, the pavement marker 130 has a significant additional advantage over the pavement marker 30, in that outer edges 152*b* of the inclined ramp surfaces 152 intersect the roadway surface 21 at an angle of only about four degrees, i.e., one-third less than the ramp angle of the pavement marker 30, and about one-third lower than the ramp angle of the prior castings, thereby significantly reducing the impact and acceleration forces imparted to the pavement marker 130, the surrounding pavement 20 and snowplow blades when such blades impact the inclined ramp surfaces of the pavement marker 130. It will be understood that the reflector assembly 70 is protected by the inclined ramp surfaces 152, and the glass layers 90 of the reflector assembly 70 are exposed to the wiping action of vehicle tires, all in the same manner as was described above with respect to the pavement marker 30.

However, because the support member 160 is not centered longitudinally with respect to the keel members 141 and 145, the arcuate recesses 195–197 cannot be simultaneously formed by the use of the cutting apparatus 100. Therefore, referring to FIGS. 16 and 17 of the drawings, there is provided an alternative form of cutting apparatus, generally designated by the numeral 200, for simultaneously cutting the recesses 195–197 in the pavement 20. The cutting apparatus 200 is generally identical to the cutting apparatus 100 except for the mounting of the cutting blades, therefore only that mounting portion of the cutting apparatus 200 will be described in detail.

More particularly, the cutting apparatus 200 includes a pair of aligned shafts or axles 204 which are rotatably mounted on the frame 101 adjacent to the front end thereof, and each has fixedly secured thereto a relatively large diameter circular cutting blade 205 and 206, dimensioned and positioned for respectively cutting the keel recesses 195 and 196 in the pavement 20. Fixedly secured to the frame 101 adjacent to the front, end thereof and extending downwardly therefrom at an acute angle thereto are a pair of support arms 208 respectively disposed just inside the large diameter cutting blades 205 and 206. Extending between the support arms 208 adjacent to the distal ends thereof and rotatably carried thereby is a horizontal shaft or axis 209 having fixedly secured thereto a plurality of smaller diameter circular blades 207 arranged closely together in side-by-side relationship so as to cut a substantially continuous arcuate recess 197 in the pavement 20 between the recesses 195 and 196, for accommodating the support member 160 of the pavement marker 130. It will be understood that the drive mechanism mounted on the frame 101 must be coupled to both of the shafts 204 as well as to the shaft 209, by any suitable means, for simultaneously rotatably driving the cutting blades 205–207. It will also be appreciated that the relative speeds of rotation of the cutting blades 205–207 could be varied by suitable gearing, all in a well-known manner.

Referring now to FIGS. 18 and 19 of the drawings, there is illustrated still another form of cutting apparatus, generally designated by the numeral 300, for cutting the recesses 195–197 in the pavement 20. The cutting apparatus 300 is essentially the same as the cutting apparatuses 100 and 200, except for the mounting arrangement for the small diameter cutting blades, wherefore only this different mounting arrangement will be described in detail.

More particularly, the cutting apparatus 300 includes a horizontal shaft or axle 304 rotatably mounted on the frame 101 adjacent to the front end thereof and having fixedly secured thereto at laterally spaced-apart points thereon, two relatively large diameter circular cutting blades 305 and 306, dimensioned and positioned for respectively cutting the keel recesses 195 and 196 in the pavement 20. Respectively pivotally mounted on the shaft 304 outboard of the cutting blades 305 and 306 are two support arms 308 which project forwardly beyond the peripheries of the large cutting blades 305 and 306. Extending between the support arms 308 and rotatably carried thereby forwardly beyond the peripheries of the large cutting blades 305 and 306 is a horizontal shaft 309 having fixedly secured thereto a plurality of smaller diameter circular cutting blades 307 which are arranged closely together in side-by-side relationship so as to cut a substantially continuous arcuate recess 197 in the pavement 20 between the recesses 195 and 196 for accommodating the support member 160 of the pavement marker 130. The support arms 308 may be pivoted about the axis of the shaft 304 either by manual means or by suitable drive mechanism carried by the frame 101. It will be understood that the shafts 304 and 309 are rotatably driven in generally the same manner as was described above with respect to the cutting apparatus 200.

In operation, the shaft 304 moves with the frame 101 in the same manner as in the cutting apparatuses 100 and 200, but the shaft 309 is independently movable and downwardly about the axis of the shaft 304 between a retracted position wherein the attached cutting blades 307 are out of engagement with the pavement, and a cutting position wherein the attached blades are disposed below the blades 305 and 306 for cutting engagement with the pavement 20. When the keel recesses 195 and 196 are being cut by the cutting blades 305 and 306, the shaft 309 will be disposed in its retracted position. After the cutting of the keel recesses 195 and 196 has been completed, the frame 101 is lifted and the support arms 308 are pivoted downwardly about the axis of the shaft 309 to move blades 307 into cutting position for cutting recess 197 at horizontal from recesses 195 and 196 for accommodating member 160. Thus, the keel recesses and the support member recess are formed sequentially, but without having to move the cutting apparatus 300 from its operating position on the pavement 20. The order of cutting of the keel recesses and the support members recess could be reversed.

Neither FIG. 18 nor FIG. 19 shows the parts of apparatus 300 in strictly realistic fashion. Thus, when blades 305 and 306 are at the lowermost positions thereof, having completed the cutting of recesses 195 and 196, blades 307 have not yet started to cut recess 197 and blades 305 and 306 are retracted from recesses 195 and 196 prior to the commencement of the cutting action of blades 307.

Both of the cutting apparatuses 200 and 300 provide quick and efficient cutting of the recesses 195–197 without the necessity of moving the cutting apparatus from its operating position on the roadway, and provide accurate and reproducible positioning of the recesses 195–197 with respect to one another.

While, for convenience of illustration, the pavement markers 30 and 130 have been illustrated with the bidirectional reflector assembly 70 mounted thereon, it will be appreciated that a monodirectional reflector assembly could also be used, and it will be understood that mono or bidirectional signal means could be used in either of the mono or bidirectional castings.

While the inclined ramps 152 of the pavement markers 30 and 130 have been disclosed with the inner and outer edges thereof at different angles of inclination, it will be appreciated that the coplanar ramps disclosed in the aforesaid abandoned parent application Ser. No. 681,858 could also be used.

From the foregoing, it can be seen that there has been provided a novel and improved bidirectional snowplowable pavement marker which includes a base member having protecting inclined ramps and a reflector assembly carried by the base member between and below the ramps and protected thereby from impact with snowplow blades, while affording high nighttime visibility from oncoming vehicles and permitting the reflector to be exposed to the wiping action of vehicle tires.

More particularly, there has been provided a pavement marker of the character described, which has a very low height above the roadway surface, and low-angled protective ramps on the base member, while nevertheless maintaining an overall length which is no greater than the overall length of similar prior art monodirectional markers.

In addition, there has been provided a pavement marker of the character described wherein the reflector assembly is carried by a support surface on the base member which is, in use, recessed below the roadway surface, the support member being constructed so as to facilitate installation thereof on the pavement.

There has also been provided improved apparatus and methods for installing the pavement markers of the present invention on the roadway by simultaneously cutting in the pavement arcuate recesses for respectively receiving the keel members and the support member of the pavement marker.

There has also been provided an alternative form of method and apparatus for sequentially cutting the recesses for the monodirectional pavement marker without the necessity of moving the cutting apparatus along the roadway.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A base member for use as a component of a low-profile pavement marker for use in snow areas for establishing on a finished roadway surface a marking visible from an oncoming vehicle while protecting the marking from damage by oncoming snowplow blades during snowplowing operations, said base member having first and second laterally spaced-apart longitudinally extending ramp members each having a lower portion and an upper portion and an inclined surface extending between a lowermost end and an uppermost end to form an inclined ramp, the lower portion of said base member defining a longitudinally extending keel portion adapted to be recessed below the roadway surface with the upper portion of each said ramp member extending above the roadway surface, and said base member further having a support member interconnecting said ramp members and providing a downwardly facing bottom surface adapted to be disposed in a complementary recess in the associated pavement and a generally upwardly facing support surface adapted to carry signal means thereon, the signal means thus adapted to be disposed between and below said ramp members with an upper portion of the signal means disposed above the roadway surface, so that an oncoming snowplow blade will ride up said ramp members and be deflected thereby from contact with said signal means as the snowplow blade passes over said pavement marker, said ramps being so configured and arranged to provide adequate space therebetween to allow vehicle tires to wipe the signal means, and whereby said bottom surface by being recessed in use below the level of the associated roadway surface enables minimization of the total height of said base member above the roadway surface thereby to reduce the impact energy imparted to said base member and the pavement and to oncoming vehicles striking said base member.

2. The base member set forth in claim 1, wherein said ramp members extend generally in the same direction as said keel portion.

3. The base member set forth in claim 1, wherein said keel portion includes first and second laterally spaced keels.

4. The base member set forth in claim 3, wherein said ramp members are parallel to each other and said keels are parallel to each other.

5. The base member of claim 4, wherein said first and second keels are vertically aligned with said first and second ramps, respectively.

6. The base member set forth in claim 1, wherein the base member has means defining a plane adapted to be substantially coincident with the roadway surface and said keel portion is below said plane.

7. The base member set forth in claim 1, wherein the base member has means including a downwardly facing surface defining a plane, said downwardly facing surface adapted to engage the roadway surface to limit the depth to which the lower portion of the base member is recessed below the roadway surface.

8. The base member set forth in claim 1, wherein said ramp members include coplanar top surfaces disposed substantially parallel to the roadway surface and respectively intersecting the uppermost ends of said inclined ramps.

9. The base member set forth in claim 1, wherein said keel portion includes first and second parallel keels and said support member interconnects said keels as well as said ramp members, said first and second keels are generally arcuate in outline along the bottoms thereof and adapted to be disposed in complementary arcuate recesses in the associated pavement and said support member bottom surface is generally arcuate in outline.

10. The base member set forth in claim 9, wherein the bottoms of said first and second keels extend farther below the roadway surface than does the bottom surface of said support member.

11. The base member set forth in claim 9, wherein said support member is disposed adjacent to one longitudinal end of said base member.

12. The base member set forth in claim 11, wherein said first and second keels are disposed adjacent to the other longitudinal end of said base member.

13. The base member set forth in claim 9, wherein the lower portions of said first and second ramp members are located adjacent to one longitudinal end of said base member and said base member also includes third and fourth laterally spaced-apart longitudinally extending ramp members aligned respectively with said first and second ramp members, each of said third and fourth ramp members having a lower portion adjacent to the other longitudinal end of said base member and an upper portion longitudinally adjacent to that one of said first and second ramp members with which it is aligned and an inclined surface extending between a lowermost end and an uppermost end to form an inclined ramp, and said support member is disposed longitudinally between said longitudinal ends of said base member.

14. The base member set forth in claim 13, wherein said base member includes a first top surface parallel to said plane and interconnecting the uppermost ends of said first and third ramp members and a second top surface coplanar with said first top surface and interconnecting the uppermost ends of said second and fourth ramp members.

15. The base member set forth in claim 14, wherein said top surfaces are disposed substantially midway between opposite longitudinal ends of said base member and said support member is centered below said top surfaces.

16. The base member set forth in claim 1, wherein said support surface is adapted to be recessed below the roadway surface and is thus adapted to carry the signal means with a lower portion thereof disposed below the roadway surface.

17. The base member set forth in claim 16, wherein said bottom surf: ce is convex.

18. The base member set forth in claim 17, wherein said bottom surface is generally arcuate in outline.

19. The base member set forth in claim 1, wherein said bottom surface is convex.

20. The base member set forth in claim 19, wherein said bottom surface is generally arcuate in outline.

21. A low-profile pavement marker for use in snow areas for establishing on a finished roadway surface a marking visible from an oncoming vehicle while protecting the marking from damage by oncoming snowplow blades during snowplowing operations, said pavement marker comprising a base member as set forth in claim 1 and, in combination therewith, a signal means disposed between and below said ramp members and carried by said support surface.

22. The pavement marker set forth in claim 21, wherein said support surface is adapted to be recessed below the roadway surface.

23. The pavement marker set forth in claim 22, wherein said signal means has a lower portion adapted to be disposed below the roadway surface and an upper portion adapted to be disposed above the roadway surface and both the upper portion of the signal means and at least a part of the lower portion thereof are operative to reflect light incident upon the upper portion of the signal means from an oncoming vehicle back toward said vehicle and said ramps are so configured and arranged to provide adequate space therebetween to allow vehicle tires to wipe at least the upper portion of the signal means.

24. The pavement marker set forth in claim 22, wherein said signal means comprises a cube corner reflex reflector having an inclined front surface disposed at an angle to the roadway surface of between 15° and 60°.

25. The pavement marker set forth in claim 22, wherein said signal means is bidirectional and includes two signal faces respectively facing toward opposite ends of said base member, said ramps being inclined with respect to the roadway surface at acute angles no greater than approximately 6° and the height of the pavement marker above the roadway surface being not greater than approximately 0.41 inches.

26. The pavement marker set forth in claim 21, wherein said bottom surface is convex.

27. The pavement marker set forth in claim 21, wherein said support surface is adapted to be recessed below the roadway surface and said bottom surface is convex.

28. The pavement marker set forth in claim 21, wherein said bottom surface is generally arcuate in outline.

29. The pavement marker set forth in claim 21, wherein said support surface is adapted to be recessed below the roadway surface and said bottom surface is generally arcuate in outline.

30. The pavement marker set forth in claim 21, wherein said support surface is substantially flat.

31. The pavement marker set forth in claim 21, wherein said support surface is substantially flat.

32. The base member set forth in claim 1, wherein said support surface is substantially flat.

33. The base member set forth in claim 32, wherein said bottom surface is convex.

* * * * *